United States Patent [19]

Giraud et al.

[11] 4,280,393

[45] Jul. 28, 1981

[54] LIGHT WEIGHT ARMORED VEHICLE

[75] Inventors: Jean Giraud, Versailles; Richard Laigneau, Saint-Maur-des-Fosses, both of France

[73] Assignee: Creusot-Loire, Paris, France

[21] Appl. No.: 28,509

[22] Filed: Apr. 9, 1979

[30] Foreign Application Priority Data

Apr. 14, 1978 [FR] France ..... 78 11017
Apr. 6, 1979 [FR] France ..... 79 08734

[51] Int. Cl.[3] ..... F41H 7/04
[52] U.S. Cl. ..... 89/36 H
[58] Field of Search ..... D12/12; 89/36 H, 40 B

[56] References Cited

U.S. PATENT DOCUMENTS

| | | | |
|---|---|---|---|
| 3,176,585 | 4/1965 | Ruf | 89/36 H |
| 3,261,263 | 7/1966 | Hilfing et al. | 89/36 H |
| 3,351,374 | 11/1967 | Forsyth et al. | 89/36 H |

*Primary Examiner*—Stephen C. Bentley
*Attorney, Agent, or Firm*—Haseltine and Lake

[57] ABSTRACT

An armored vehicle comprising a motor, roller members and a transmission for transmitting drive from the motor to the roller members. The vehicle comprises a body including a highly armored main central cell surrounding the personnel and essential mechanical members of the motor and transmission, and a much lighter exterior protection surrounding the main cell and extending beyond the roller members.

8 Claims, 6 Drawing Figures

9
10
13
8
3
5
18
25
4
15
1

23
6
12
9
10
13
15
22
5
16
3
19
18
25
1

LIGHT WEIGHT ARMORED VEHICLE

FIELD OF THE INVENTION

The present invention relates to a light weight armored vehicle and is applicable to all types of military vehicles utilizable as combat vehicles, liaison vehicles, or reconnaissance, vehicles.

PRIOR ART

Lightweight vehicles for liaison or for reconnaissance generally utilized up to the present were most often open or substantially open and provided practically no protection for the passengers even against projectiles from small arms. This made their utilization dangerous in combat zones or in zones capable of being reached by small arms of infantry or by shell fragments. Vehicles providing effective protection against such fire have been, up to the present relatively heavy vehicles by reason of the substantial armoring surface necessary to enclose the area occupied by the personnel and vital members. The weight of such vehicles constitutes a handicap to their mobility.

A problem of the same order is found for much heavier armored vehicles, such as combat tanks in which the need for a great thickness of armoring to provide sufficient resistance for projectile impacts, and the large size of the protective surface to externally enclose all of the vehicle is translated into a very substantial weight of the body. This leads to an increase, in significant fashion, of the energy necessary to drive the vehicle or in contrast, it limits its speed and in more general fashion its mobility, and consequently leads to its vulnerability.

SUMMARY OF THE INVENTION

An object of the present invention is to provide an armored vehicle providing a high quality of protection to the occupants and to vital members of the vehicle while remaining within acceptable weight limits.

The invention is applicable to an armored vehicle constituted by a body carried by rolling members, and comprising motor members and means for transmission of the drive from the motor to the rolling members, with stations for personnel in the interior of the body.

According to the invention the body is constituted by two elements:

(a) a main central cell strongly armored and of a volume reduced to that which it is necessary to contain the occupants and the vital members of the motor and transmission units, (b) an exterior protection of much lighter armoring surrounding the main cell at least at the front and rear.

According to a particular embodiment of the invention, in the case of a vehicle on wheels, the main central cell is, longitudinally, entirely comprised between the end axles of the roller members.

The invention will be better understood with reference to particular embodiments given by way of example and illustrated in the attached drawing.

DETAILED DESCRIPTION

Figures 1, 2:
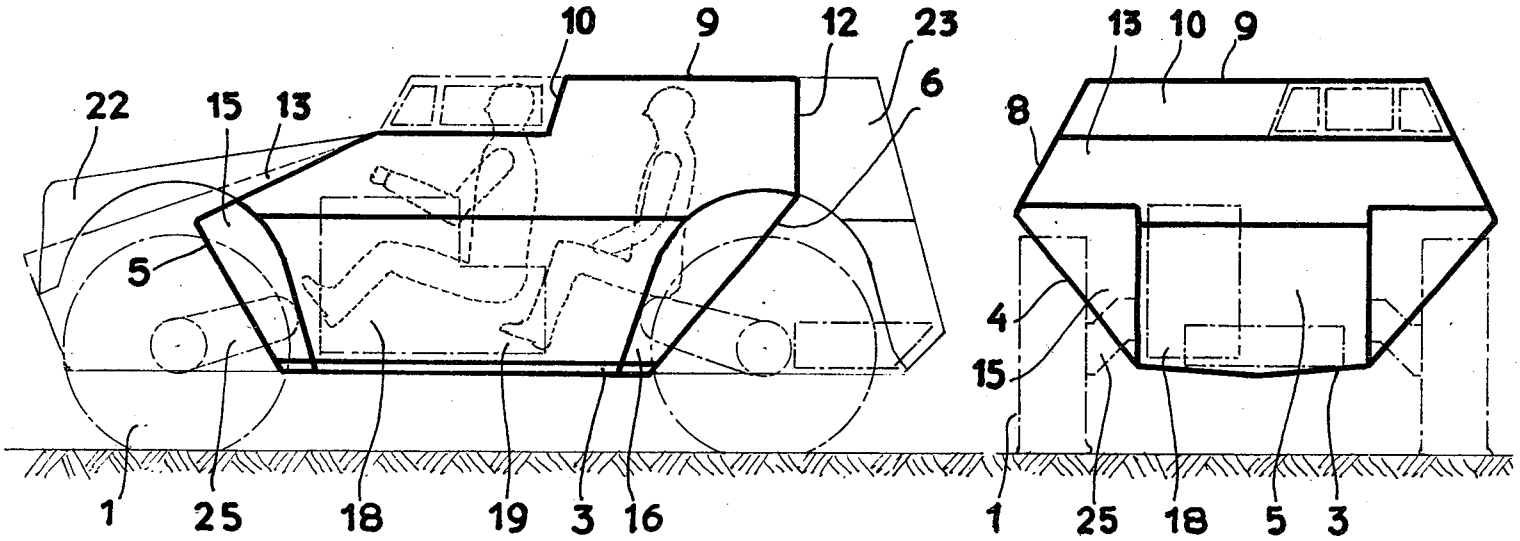
FIG. 1 is a side view in simplified manner of a lightweight vehicle adapted for the transport of personnel according to the invention.
FIG. 2 also shows in simplified manner, an end view of the vehicle.
Figure 3:
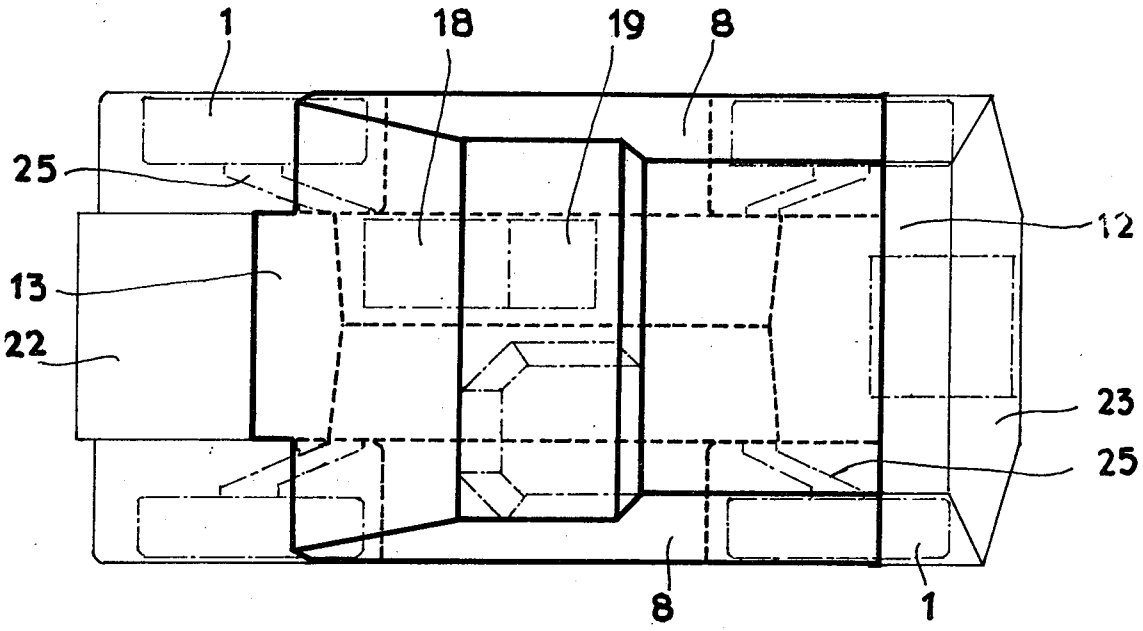
FIG. 3 is a top plan view of the vehicle.

In FIGS. 1 to 3, the vehicle has been voluntarily shown without a great number of auxiliary accessories, and even its defense armament, in order only to illustrate particularly the elements of the body which represent the object proper of the invention. In FIG. 2, the vehicle is shown without its light exterior protection.

The vehicle, which rests on four independent wheels 1, is primarily constituted by a central armored frame shown in heavy outline in the drawings. It is formed from relatively thick armored sheets to form a substantially closed cell. In its internal part this central cell comprises a floor 3 having a slight dihedron, lateral inclined walls 4, as well as front and rear end walls 5 and 6. In its upper portion, the lateral sheets 8 are inclined with a slope reverse that of the lower lateral walls, and the roof 9 has two levels separated by a wall 10. The assembly is completed by a substantially vertical rear wall 12 and a front hood 13 which is very inclined with respect to the horizontal. Lateral housings 15 and 16 are respectively provided at the front and the rear to permit the passage and the arrangement of the wheels of the vehicle.

It will be noted that this central cell, highly protected by a relatively thick armoring, is of a very limited volume only to protect the occupants of the vehicle and the vital members for propulsion. Thus, the motor 18 and the transmission 19 are included in this central cell and one could also provide hereat an intermediate fuel supply forming a buffer tank between the main fuel tank and the motor.

The strongly protected central region is prolonged at the front and rear by frames 22 and 23 which extend beyond the wheels while also providing housings for the passage and arrangement of the wheels. These frames are also made from welded armored sheets but the thickness is substantially less than that of the central cell. The free space between the central cell and the exterior armoring is occupied by less vital members of the motor equipment, as for example, the main fuel tank, the steering members or the arms 25 for suspension and for transmission of drive to the wheels.

It is clearly understood from the description which has just been given that the vehicle thus constructed remains a light weight vehicle since the heavy armoring is only utilized to protect a small portion of the total volume of the vehicle, the remainder of the body being formed of thin sheets. However, with respect to a conventional light vehicle utilized up to the present, the protection for the occupants is considerably increased. This protection results mainly, of course, from the presence of the armoring but also from the orientation of the sheets constituting the central cell, this presenting almost always a sufficient angle with respect to the direction of impact of bullets to facilitate the effect of ricochet on the walls. On the other hand, the end frames, even if they are traversed by projectiles, will act to damp the impact and change the direction of the projectiles which will make it still more difficult for them to traverse the central armoring.

Further to be noted is the disposition, clearly illustrated in the drawings, of the central cell which is entirely comprised between the axles of the wheels; this disposition increases the security of the vehicle with respect to mines. If, in fact such a vehicle sets off the explosion of a mine, this will be by the passage of one of the wheels on the mine and the resulting explosion will take place at a certain distance from the central cell and without the floor being directly above the mine; the inclination of the lower walls 4, 5 or 6 of the central cell will also tend to produce a ricochet of the schrapnel.

Such disposition therefore protects, in spite of its light weight, both the passengers as well as the vital members of the vehicle. Even in the case of serious damage to the external portion of the drive transmission to one of the wheels, it will remain reasonable, by means of the intact motor, for the possibility of the occupants to travel several dozens of meters which most often will be sufficient for them to take cover.

One could further envisage also surrounding the central cell by a light weight lateral armoring. One could further imagine, in the case where the light weight properties would be less imperative, to fill at least partially, the free space between the main cell and the light weight exterior armoring by means of products, such as, for example, plastic foam capable of slowing down projectiles having already traversed the exterior armoring.

Figure 5:
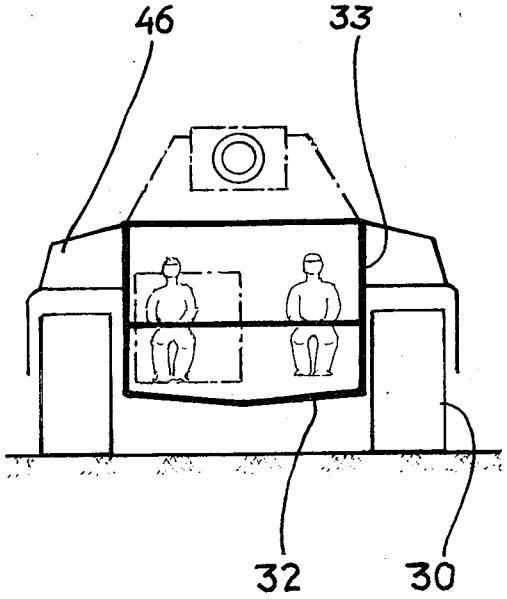
FIGS. 4 to 6, are views corresponding to FIGS. 1 to 3 for a combat tank.
Figure 4:
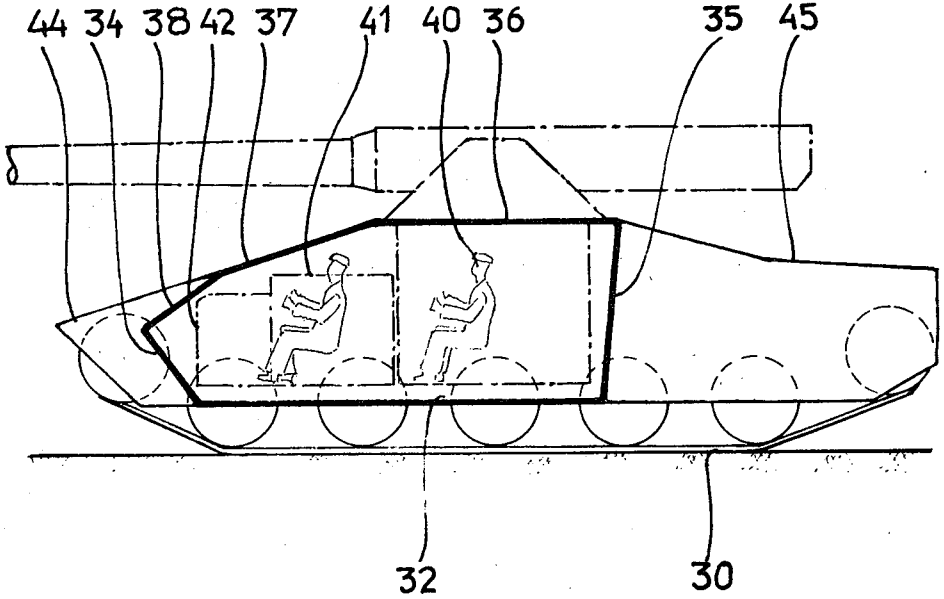
Figure 6:
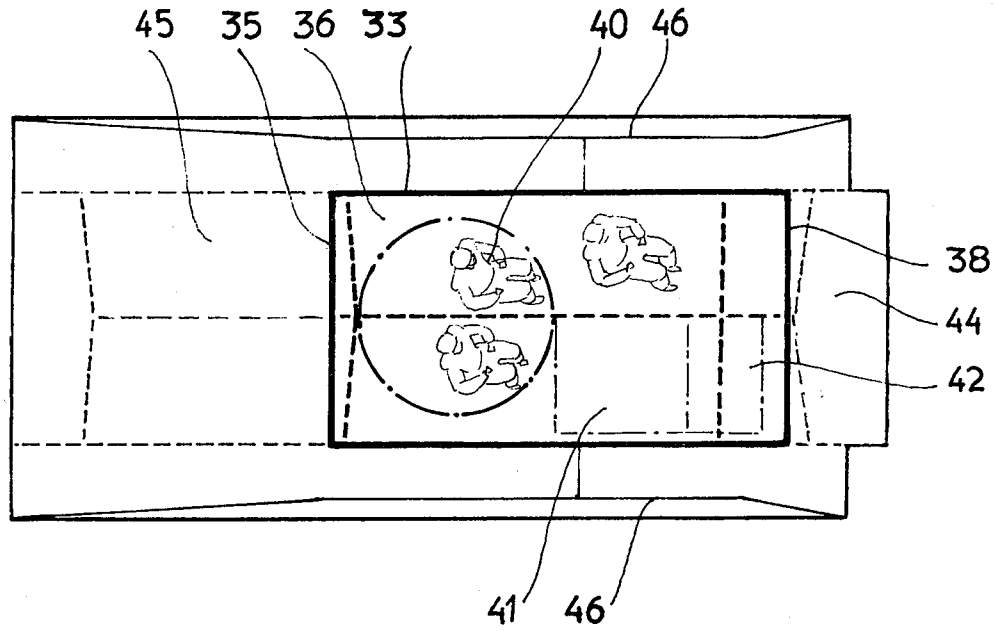

Referring now to FIGS. 4 to 6, the vehicle is constituted as a combat tank which is carried by two tracks 30 and comprises a strongly armored central cell shown in heavy solid lines in the drawing. The central cell is formed from thick welded armoring sheets to form a substantially closed cell of a generally parallelepiped shape with a floor 32 having a slight dihedron and two lateral vertical walls 33. At the front, the end wall 34 is steeply inclined whereas the rear wall 35 is substantially vertical. The roof 36 is prolonged by two inclined portions forming hoods 37 and 38.

It should be noted that there is thus constituted a central cell highly protected by a thick armoring, but of a limited volume and, consequently, of a very limited weight, for only protecting the occupants 40 of the vehicle as well as the vital propulsion members, such as the motor 41 or the transmission 42. Of course, the lateral walls of this central cell are provided with openings for the passage of members for transmission of power to the drive for the tracks. Similarily, the roof 36 is provided with openings for access to the rotatable turret.

The strongly protected central cell is extended at the front and rear by frames 44 and 45 which, with the lateral frames 46, complete the external envelope of the totality of the vehicle. These frames are also made of welded armored sheets but the thickness is less than that of the sheets of the central cell.

The free space between the central cell and the exterior armoring is occupied by less vital members than the motor equipment, for example, fuel tanks, the steering members or the arms for transmission of drive to the tracks.

It is seen that in such vehicle, the protection of the occupants and of the important members such as the motor and the transmission is at least equal to that which is obtained by current vehicles, since it is achieved by sheets of great thickness. However, the entire vehicle is considerably reduced in weight by the reduction of the thickness of the remainder of the sheets enveloping the vehicle. It should be further noted that the end or lateral frames, even when they are traversed by projectiles, by damping the impact and changing their direction, make it still more difficult to traverse the armoring of the central cell.

Of course the invention is not strictly limited to the embodiments which have been described by way of example, but it also covers embodiments which are distinguished only in details, by variants of execution or by the utilization of equivalent means.

What is claimed is:

1. An armored vehicle comprising a body having an outer profile, rolling members supporting said body, motor means, transmission means for transmitting drive from said motor means to said rolling members, said body comprising a main central cell having a volume reduced to that for containing occupants and at least selected vital elements of said motor means and transmission means, said main central cell comprising relatively thick highly armored plates and which include a floor of said central cell having a slight dihedron, and an exterior protection extending from said main cell to complete the outer profile of said body, said exterior protection comprising relatively thin armored plate, said exterior protection extending from said central cell at least at the front and rear thereof.

2. An armored vehicle as claimed in claim 1 wherein said central cell includes walls of relatively steep inclination.

3. An armored vehicle as claimed in claim 1 comprising axles for said rolling members, said cell being disposed between the axles of said rolling members.

4. An armored vehicle as claimed in claim 1 wherein said central cell includes lower lateral walls which are inclined with respect to the horizontal.

5. An armored vehicle as claimed in claim 4 wherein said central cell includes upper lateral walls which are inclined with respect to the horizontal in opposite direction compared to the lower lateral walls.

6. An armored vehicle as claimed in claim 5 wherein said lower lateral walls diverge upwardly and said upper lateral walls converge upwardly.

7. An armored vehicle as claimed in claim 4 wherein said central cell includes end walls which are inclined.

8. An armored vehicle as claimed in claim 7 wherein said end walls diverge upwardly.

* * * * *